US009023193B2

(12) United States Patent
Koseoglu

(10) Patent No.: US 9,023,193 B2
(45) Date of Patent: May 5, 2015

(54) PROCESS FOR DELAYED COKING OF WHOLE CRUDE OIL

(75) Inventor: Omer Refa Koseoglu, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 13/113,196

(22) Filed: May 23, 2011

(65) Prior Publication Data

US 2012/0298552 A1 Nov. 29, 2012

(51) Int. Cl.
*C10G 11/02* (2006.01)
*C10G 9/14* (2006.01)
(Continued)

(52) U.S. Cl.
CPC ..... *C10B 55/00* (2013.01); *C10B 57/045* (2013.01); *C10B 57/06* (2013.01); *C10G 9/005* (2013.01); *C10G 31/08* (2013.01); *C10G 55/04* (2013.01); *C10G 55/06* (2013.01); *C10G 11/02* (2013.01); *C10G 2300/301* (2013.01); *C10G 2300/4081* (2013.01); *C10G 2400/02* (2013.01);
(Continued)

(58) Field of Classification Search
CPC ..... C10B 55/00; C10B 57/045; C10B 57/06; C10G 11/02; C10G 2300/1033; C10G 2300/301; C10G 2300/4006; C10G 2300/4081; C10G 2400/02; C10G 2400/06; C10G 31/08; C10G 55/04; C10G 55/06; C10G 9/005
See application file for complete search history.

(56) References Cited

U.S. PATENT DOCUMENTS 2,224,570 A 12/1940 Dieserud
2,380,713 A 7/1945 Wilson
(Continued)

FOREIGN PATENT DOCUMENTS

WO 2004/104139 A1 12/2004

OTHER PUBLICATIONS

Statoil.com, ALBA Crude Summary Report, 2002 (retreived Feb. 7, 2012).*
(Continued)

*Primary Examiner* — Walter D Griffin
*Assistant Examiner* — Derek Mueller
(74) *Attorney, Agent, or Firm* — Abelman, Frayne & Schwab

(57) ABSTRACT

An improved delayed coking process utilizing a coking unit and a coking unit product fractionating column which includes the steps of:

heating a mixture of a fresh whole crude oil feedstream and the bottoms from the coking unit product fractionator in a furnace to a coking temperature in the range of 480° C. to 530° C./896° F. to 986° F.;

introducing the heated mixed whole crude oil and bottoms feedstream directly into the delayed coking unit;

optionally passing the vaporized liquid and gaseous coking unit product stream into a flash unit;

recovering a light product gas stream that includes $H_2S$, $NH_3$ and C1 to C4 hydrocarbons from the flash unit;

transferring the bottoms from the flash unit to the coking unit product fractionating column;

recovering as separate side streams from the fractionating column naphtha, light gas oil and heavy gas oil;

recycling a portion of the heavy gas oil by introducing it into the fractionating column optionally with the bottoms from the flash unit;

mixing the fractionating column bottoms with the whole crude oil feedstream to form the mixed feedstream; and introducing the mixed whole crude oil and fractionating column bottoms feedstream into the furnace.

15 Claims, 4 Drawing Sheets

(51) Int. Cl.

| | |
|---|---|
| ***C10G 31/06*** | (2006.01) |
| ***C10G 55/04*** | (2006.01) |
| ***C10B 55/00*** | (2006.01) |
| ***C10B 57/06*** | (2006.01) |
| ***C10B 57/04*** | (2006.01) |
| ***C10G 9/00*** | (2006.01) |
| ***C10G 31/08*** | (2006.01) |
| ***C10G 55/06*** | (2006.01) |

(52) U.S. Cl.
CPC .... *C10G2400/06* (2013.01); *C10G 2300/1033* (2013.01); *C10G 2300/4006* (2013.01)

(56) References Cited

U.S. PATENT DOCUMENTS

| | | | | |
|---|---|---|---|---|
| 3,116,231 | A | 12/1963 | Adee | |
| 3,238,117 | A * | 3/1966 | Arey, Jr. et al. | 208/53 |
| 3,379,638 | A | 4/1968 | Bloomer et al. | |
| 3,472,761 | A | 10/1969 | Cameron | |
| 3,563,884 | A | 2/1971 | Bloomer et al. | |
| 3,617,480 | A | 11/1971 | Keel | |
| 4,036,736 | A | 7/1977 | Ozaki et al. | |
| 4,049,538 | A | 9/1977 | Hayashi et al. | |
| 4,058,451 | A * | 11/1977 | Stolfa | 208/97 |
| 4,066,532 | A | 1/1978 | Garcia | |
| 4,071,433 | A | 1/1978 | Hanson | |
| 4,108,798 | A | 8/1978 | Sze et al. | |
| 4,177,133 | A | 12/1979 | Kiyoshige et al. | |
| 4,216,074 | A | 8/1980 | Simone | |
| 4,388,152 | A | 6/1983 | Wasson et al. | |
| 4,394,250 | A | 7/1983 | Grossberg | |
| 4,455,219 | A | 6/1984 | Janssen et al. | |
| 4,492,625 | A | 1/1985 | Allan | |
| 4,661,241 | A | 4/1987 | Dabkowski | |
| 4,797,197 | A | 1/1989 | Mallari | |
| 4,853,106 | A | 8/1989 | Grove et al. | |
| 5,316,655 | A | 5/1994 | Paspek et al. | |
| 5,350,503 | A | 9/1994 | Freymeyer et al. | |
| 6,043,182 | A | 3/2000 | Cordova et al. | |
| 7,381,320 | B2 | 6/2008 | Iqbal et al. | |
| 2004/0256292 | A1 | 12/2004 | Siskin et al. | |
| 2004/0262198 | A1 * | 12/2004 | Siskin et al. | 208/131 |
| 2009/0127090 | A1 | 5/2009 | Ganji | |

OTHER PUBLICATIONS

Ellis, P, Tutorial: Delayed Coking Fundamentals, AICHE,1998, Presented at AlChE 1998 Spring Meeting, pp. 1-20.*

J.F. Schabron, J.G. Speight, "An Evaluation of the Delayed-Coking Product Yield of Heavy Feedstocks Using Asphaltene Content and Carbon Residue", Oil & Gas Science and Technology—Rev. IFP, vol. 52 (1997), No. 1, pp. 73-85.

International Search Report and Written Opinion mailed Aug. 30, 2012 by the International Search Authority in International Application No. PCT/US2012/037782 (14 pages).

* cited by examiner

PROCESS FOR DELAYED COKING OF WHOLE CRUDE OIL

FIELD OF THE INVENTION

This invention relates to a process for the delayed coking of whole crude oil.

BACKGROUND OF THE INVENTION

Delayed coking is a thermal cracking process used in petroleum refineries to upgrade and convert petroleum residuum, which are typically the bottoms from the atmospheric and vacuum distillation of crude oil, into liquid and gas product streams leaving behind petroleum coke as a solid concentrated carbon material. A fired heater or furnace, e.g., of the horizontal tube type, is used in the process to reach thermal cracking temperatures of 485° C. to 505° C./905° F. to 941° F. With a short residence time in the furnace tubes, coking of the feed material is thereby "delayed" until it is discharged into large coking drums downstream of the heater.

In the practice of the delayed coking process, a hydrocarbon oil is heated to a coking temperature in a furnace or other heating device and the heated oil is introduced into a coking drum to produce a vapor phase product, which also forms liquid hydrocarbons, and coke. The drum can be decoked by hydraulic means or by mechanical means. In most configurations of the delayed coking process, the fresh hydrocarbonaceous feed to the coking unit is first introduced into a coker product fractionating column, or fractionator, usually for heat exchange purposes, where it combines with the heavy coker oil products that are recycled as bottoms to the coking unit heater.

It is known that decreasing the recycle ratio of the fractionator bottoms that are recycled to the delayed coker preheater results in an increase in the hydrocarbon liquid yield and a decrease in the coke yield of the delayed coker and, conversely, that as the recycle ratio is increased, the coke yield also increases. Thus, the effect of the recycle ratio to coke yield is such that as recycle decreases, the cut point of the recycle increases. Other operating conditions that effect the delayed coking are drum temperature and pressure. As the temperature is increased, the coke yield decreases and a harder type of coke is produced. An increase in drum pressure produces an increase in the yield of both coke and gases. A delayed coking process is disclosed in U.S. Pat. No. 4,492,625 in which the hydrocarbon feedstock having a boiling point of 925° F./450° C. is split before the preheating step with one portion being sent to the delayed coking unit preheater and a second portion being introduced directly into the coker unit product fractionator. At least a portion of the bottom residue, or bottoms, from this fractionator is recycled to the preheater where it is combined with the fresh hydrocarbon feedstock, and the combined feedstock is heated to a predetermined temperature and passed to the delayed coking unit.

The boiling point of the feedstream employed in the process described in the '625 patent indicates that the hydrocarbon feedstream had been previously upgraded, e.g., by fractional distillation, before its processing in the delayed coking unit and its introduction into the fractionator above the coker unit product feed to the fractionator. There is no significant effect on the capital or operating costs associated with the operation of the product fractionator in this mode. Rather, it is equivalent to the conventional steps of atmospheric distillation followed by vacuum distillation of whole crude oil, followed by coking of the residuum or bottoms.

A process is described in U.S. Pat. No. 4,066,532 for delayed coking in which the fresh feedstock is introduced to a preheating furnace as a mixture with the bottoms and a portion of the heavy gas oil side stream from the coker unit product fractionator, or fractionating column. It is stated that the recycling of the heavy gas oil will result in an increase in the aromaticity of this side stream, a portion of which can advantageously be used for carbon black production. The fresh feedstock is described as including coal tar and decanted cracking oil having prescribed sulfur, ash and asphaltene contents. The temperature of the mixed feedstock is raised to 450° C. to 510° C./842° F. to 950° F. in the preheating furnace.

A catalytically enhanced delayed coking process is described in U.S. Pat. No. 4,394,250 in which from about 0.1% to 3% of catalyst and hydrogen are added to the feedstock before it is introduced into the furnace with a portion of the fractionator bottoms. The feedstock is selected from heavy low-grade oil such as heavy virgin crude, reduced crude, topped crude, and residuums from refining processes.

A problem exists with respect to the utilization of coking units in refinery processes because of the need to use a feedstream that is the product of atmospheric and/or vacuum distillation, which will require either the construction of new distillation facilities for this purpose or an increase of the burden on existing facilities, both of which alternatives will result in an increase in capital and/or operating costs.

Computer models can be used advantageously in evaluating whether process modifications are technically feasible and economically justifiable. The use of computer modeling is described by J. F. Schabron and J. G. Speight in an article entitled "An Evaluation of the Delayed-Coking Product Yield of Heavy Feedstocks Using Asphaltene Content and Carbon Residue", *Oil & Gas Science and Technology—Rev. IFP*, Vol. 52 (1997), No. 1, pp. 73-85.

It would be desirable to provide an improved coking process that enhances the overall efficiency of the preliminary refining process associated with upgrading crude oil and to reduce capital and operating costs for new facilities associated with coking processes of the prior art.

As used herein, the terms "coking unit" and "coker" refer to the same apparatus, and are used interchangeably. The terms "fractionating column" and "fractionator" refer to the same apparatus and are also used interchangeably.

SUMMARY OF THE INVENTION

The desired efficiencies and other advantages are realized by the improved process of the present invention in which the principal feedstream for the delayed coking unit is whole crude oil. The improved process broadly comprehends the steps of:

heating the entire fresh whole crude oil feedstream and the bottoms from the coker product fractionator, or fractioning column, in a furnace to a coking temperature in the range of 480° C. to 530° C./896° F. to 986° F.;

introducing the heated mixed whole crude oil and bottoms feedstream directly into the delayed coking unit at a pressure corresponding to a pressure in the coking drum that is in the range of from 1-3 kg/cm$^3$;

passing the liquid and gaseous output stream from the coking unit to a flash unit; recovering a light product gas stream that includes $H_2S$, $NH_3$ and C1 to C4 hydrocarbons from the flash unit;

transferring the bottoms from the flash unit to the coker product fractionator;

recovering as separate side streams from the coker product fractionator naphtha, light gas oil and heavy gas oil;

recycling the heavy gas oil by introducing it with the bottoms from the flash unit into the coker product fractionator;

mixing the fractionator bottoms with the whole crude oil feedstream to form a mixed feedstream; and heating the mixed whole crude oil and fractionator bottoms feedstream in the furnace to thereby continue the process.

As used in conjunction with the process of the present invention, the term "whole crude oil" will be understood to include feedstocks of crude oil, bitumen, tar sands and shale oils, and synthetic crude oils produced by upgrading bitumen, tar sands and shale oils. Synthetic crudes are typically upgraded to a transportable or flowable form.

Suitable feedstocks for use in the process of the invention include those having an initial boiling point in the range of from 36° C. to 565° C. The feedstock can comprise light fractions boiling in the range of 36° C. to 370° C. and containing from 1 to 60 W %, and preferably from 1 to 25 W %, and most preferably from 1 to 10 W % of lower boiling components. Feedstocks boiling in the range of from 36° C. to 565° C. can contain from 1 to 90 W %, preferably from 1 to 50 W % and most preferably from 1 to 25 W % of light fractions. The feedstock hydrogen content of the light fractions present is preferably in the range of 12 to 16 W %. The feedstock can contain dissolved gases, such as methane, ethane, propane and butanes, in the concentration of from 0 to 3 volume percent (V %). These dissolved gases can have the effect of lowering the initial boiling point to below 36° C.

The process and system of the invention provides the following benefits:

1. the direct coking of whole crude oil with no preliminary atmospheric and vacuum fractionation eliminates conventional distillation units;
2. a decreased coke yield and increased coke quality because of the light feedstock components, i.e., naphtha and gas oil content, act as hydrogen donor solvents;
3. the cracking of lighter components such as the vacuum gas oil tail end in the coker and the cracking of very light components also takes place, but it will be minimal because these components will be vaporized and have less residence time;
4. the operation will be easier because of the light nature of the feedstocks, and the light components (naphtha and gas oils) will also minimize the coke build-up in the furnace tubes due to their solvent effect and will strip coke precursors from the furnace tubes to reduce coke build-up; and
5. optionally adding a homogenous catalyst will enhance the cracking reactions by facilitating hydrogen transfer between the paraffinic hydrogen-rich molecules and heavy molecules by stabilizing the free radicals formed in the presence of hydrogen-rich donor solvents (e.g., the naphtha and diesel fractions).

In an embodiment of the process of the invention, the whole crude oil feedstream is first desalted and demineralized using conventional methods that are well known in the art.

The coking unit process is preferably conducted as a batch-continuous process by providing at least two vertical coking drums that are operated in swing mode. This allows the flow through the tube furnace to be continuous. The feedstream is switched from one to the other, or to another, of the at least two drums. In a coking unit with two drums, one drum is on-line filling with coke while the other drum is being steam-stripped, cooled, decoked, pressure checked and warmed up. The overhead vapors from the coke drums flow to a product fractionator, or fractionating column.

Optionally, this fractionator can have a reservoir in the bottom where the fresh feed is combined with the heavy condensed product vapors, or recycle bottoms, to preheat the fresh crude oil upstream of the coker heater furnace.

In an embodiment of the process of the invention, an optional flash unit is provided downstream of the coking drum to enhance the separation of the coker product stream. The flash unit operating conditions are determined on the basis of the quality of the product separation. The products can be flashed at the coker unit's outlet temperature or at lower temperatures, provided that the coker products are cooled. The cooling can be provided by heat exchange with the whole crude oil feedstock and/or by air coolers and/or water coolers. Depending upon the temperature of the coker product stream, the flash temperature can range from 45° C.-496° C. The pressure of the flash unit is less than the coker outlet pressure, i.e., 1-3 $Kg/cm^2$, taking into account the pressure drop in the equipment.

Although horizontal tube furnaces heated by direct contact with burning fuel are in widespread commercial use and are presently preferred, other types of furnaces known in the art can be employed in the process of the invention.

Any of various methods known in the art for cooling, decoking and preheating the empty drum for use can be employed and form no part of the claimed invention.

In one embodiment of the process of the invention, a homogenous catalyst is added to the whole crude oil feedstream prior to its introduction into the furnace. Alternatively, the catalyst can be added to the combined mixture of the coking unit product fractionator bottoms and the whole crude oil. The catalyst is selected for its ability to stabilize the free radicals formed by the thermal cracking and to thereby enhance the thermal cracking reactions.

Suitable catalysts include homogeneous oil-soluble catalysts that are produced by the combination of an oxide, a sulfide, or a salt of a metal selected from group IV through group VIII of the Periodic Table, including transition metal-based catalysts derived from an organic acid salt or metal-organic compounds of molybdenum, vanadium, tungsten, chromium, iron, and other materials. Examples include vanadium pentoxide, molybdenum alicyclic aliphatic carboxylic acids, molybdenum naphthenate, nickel 2-ethylhexanoate, iron pentacarbonyl, molybdenum 2-ethyl hexanoate, molybdenum di-thiocarboxylate, nickel naphthenate and iron naphthenate.

The addition of a catalyst does not change the operating conditions since the catalyst is oil-soluble and is added in parts per million based on weight (ppmw) quantities. The catalyst can range from 1-10000 ppmw, preferably 1-1000 ppmw, and most preferably from 1-100 ppmw.

The catalyst can be added upstream of the furnace at, or proximate the point at which the fractionator bottoms are combined to form the mixed feedstream. In an optional embodiment, the catalyst can be added downstream of the furnace. Since the catalyst is homogeneous and oil-soluble, it can be added directly. If the catalyst is prepared from metal oxides or conditioned before use, a separate step is necessary for the catalyst preparation. Methods for the preparation of suitable oil-soluble catalysts are well known in the art and form no part of the present invention.

No changes in the operating conditions in the coking unit are required when catalysts are included in the mixed whole crude oil feedstream.

As noted above, the catalyst can, for example, be mixed with the crude oil feedstream before the furnace or with the mixed crude oil and fractionator bottoms feedstream. The amount of catalyst added is based upon the fresh crude oil feedstream, e.g., parts per million based on weight (ppmw), and can be predetermined based upon known factors, including the characteristics of the crude oil, the type of catalyst used and the coking unit operating conditions, i.e., temperature and pressure. The determination of the amount of catalyst to be added is within the ordinary skill of the art and forms no part of the present invention.

BRIEF DESCRIPTION OF THE DRAWINGS

The invention will be described in further detail below and in conjunction with the attached drawings in which the same or similar elements are referred to by the same number, and where.

DETAILED DESCRIPTION OF THE INVENTION

Figure 1:
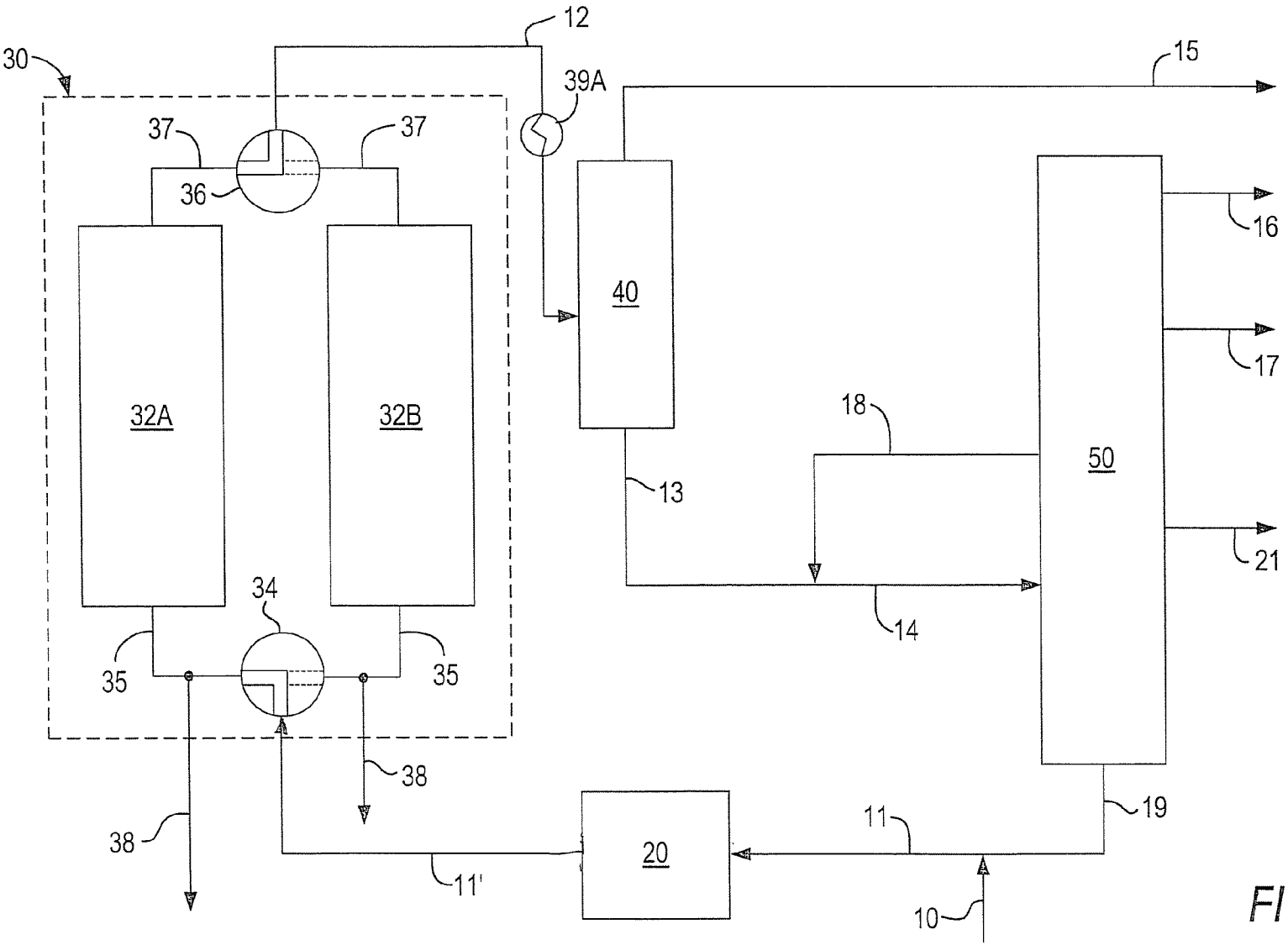
FIG. 1 is a schematic illustration of an embodiment of the process of the invention which includes a flash vessel.

Referring now to the process and apparatus schematically depicted in FIG. 1, there is shown whole crude oil feed 10, furnace 20 for heating the feed to the delayed coking unit 30, a flash vessel 40 for effecting a preliminary separation of light gases from the delayed coking unit product stream and a delayed coking unit product fractionator 50.

Once a steady-state operating condition has been achieved, a whole crude oil feedstream is introduced through feed line 10 and combined with the fractionator bottoms 19 to form the combined mixed feedstream 11 that is introduced into the furnace 20, which can be a horizontal tube furnace of conventional design. The temperature of the mixed feedstream 11' is closely monitored and controlled in the furnace utilizing appropriately positioned thermocouples, or other suitable temperature-indicating sensors (not shown) in order to avoid or minimize the undesirable formation of coke in the tubes of the furnace. The automation of the sensors and control of the heat source, e.g., open flame heaters, is within the skill of the art and forms no part of the present invention.

The delayed coking unit 30 is shown with two coking drums 32 having drum inlet lines 35 and inlet control valve 34 and outlet control valve 36 and drum outlet lines 37. The flow of the heated feedstream 11' from furnace 20 is directed into one of the coking drums 32 via feed line 35 by adjustment of inlet control valve 34, e.g., a three-way valve. When a drum contains the predetermined maximum amount of coke, control valve 34 is adjusted to direct the heated feedstream 11' into the other drum. At the same time, coking drum outlet valve 36 is adjusted so that the coker product 12 is discharged through line 37. Coke that is subsequently removed from a drum when it is out of service is schematically represented at 38.

In accordance with the embodiment illustrated in FIG. 1, the coking unit product stream 12 is optionally introduced into flash vessel 40 for separation and recovery of the light gases product stream 15 which can include the C1 to C4 hydrocarbons, and hydrogen sulfide and ammonia. In this embodiment, the temperature of the coking unit product stream 12 is reduced by passing it through heat exchanger 39A, which can be a steam generator in order to capture the energy values for use in plant facilities. The bottoms 13 from the flash unit 40 are mixed with a portion of the heavy gas oil that is withdrawn as a recycle side stream 18 from the downstream coking unit product fractionator 50. The mixed stream 14 formed from the flash unit bottoms 13 and heavy gas oil stream 18 is fed into the product fractionator 50, from which are recovered a naphtha side stream 16, a light gas oil sidestream 17 and a heavy gas oil sidestream 21, which is the remaining portion of the previously-mentioned heavy gas oil recycle stream 18.

Also as previously described, the fractionator bottoms 19 from the fractionator 50 are recycled for mixing with the fresh whole crude oil feedstream 10 prior to passing into the furnace 20 as the mixed furnace feedstream 11.

The operating temperature in the coking drum can range from 425° C. to 650° C., is preferably from 450° C. to 510° C., and is most preferably from 470° C. to 500° C. The operating pressure in the coking drum is mildly super-atmospheric in the range of from 1-20 kg/cm$^2$, preferably from 1-10 kg/cm$^2$ and most preferably from 1-3 kg/cm$^2$.

In a preferred embodiment of the process, steam is introduced with the feedstream into the furnace at about 1-3 w % of the feedstock to increase the velocity in the tube furnace, and to reduce the partial pressure of the feedstock oil in the drum. The steam also serves to increase the amount of gas oil removed from the coke drums. Steam also helps decoking of the tubes in the event of a brief interruption of the feed flow.

The practice of the delayed coking process in accordance with the present invention achieves the delayed coking of whole crude oil directly and without the preliminary atmospheric and/or vacuum distillation steps of the prior art. Because of the high paraffinic content of the whole crude oil feedstream as compared to the processes of the prior art, the amount of coke produced in the drum is relatively lower per unit of volume of feedstream processed and the quality of the coke is improved. The process of the invention also has the advantage of thermally cracking the lighter components, such as the vacuum gas oil tail in the coking unit.

Figure 2:
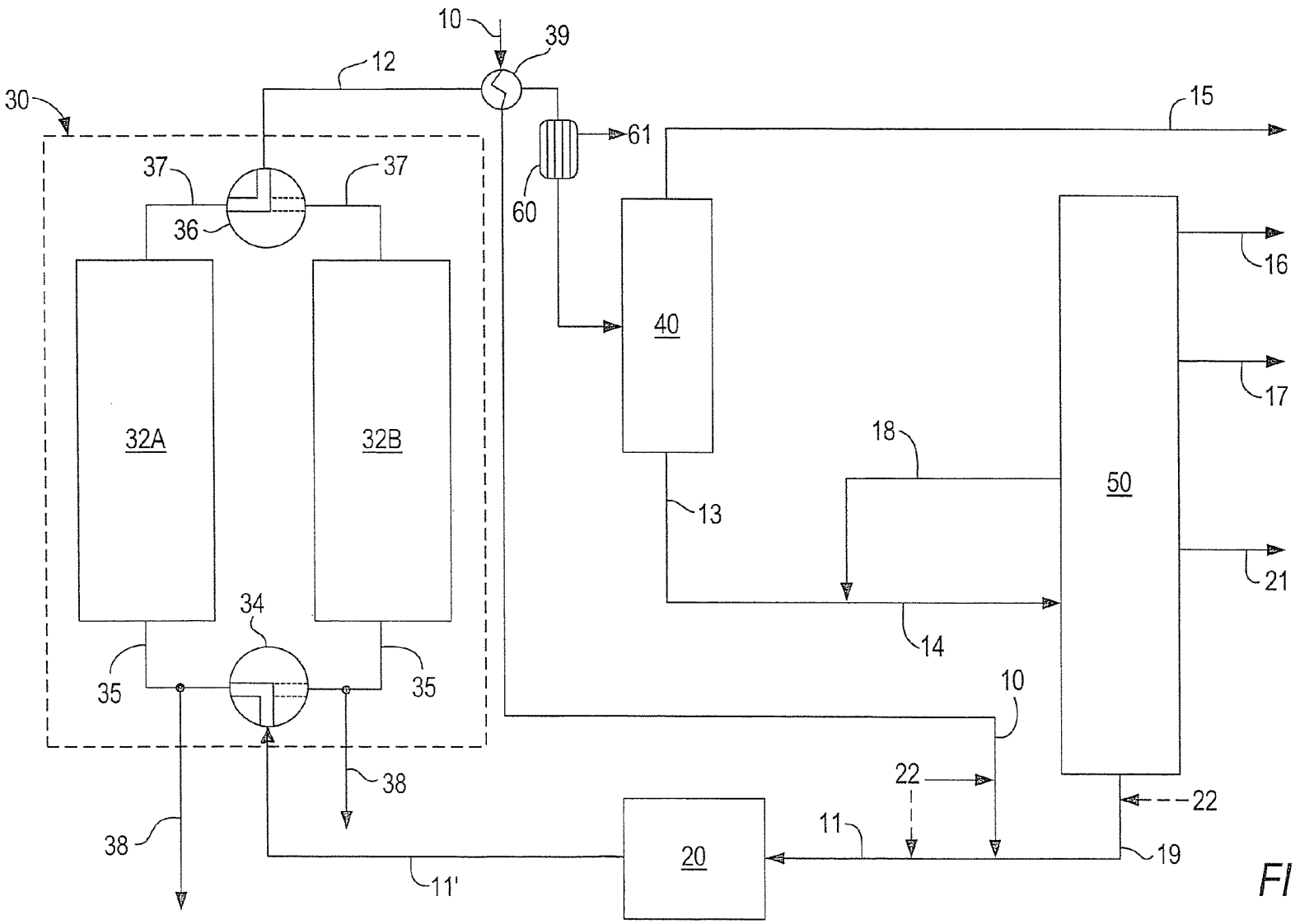
FIG. 2 is a schematic illustration similar to FIG. 1 in which catalyst is added to the crude oil feedstream upstream of the delayed coking unit furnace.

Referring now to FIG. 2, a second embodiment for the practice of the process of the invention will be described utilizing a catalyst and with the optional flash vessel. The catalyst 22 is for example, mixed with the whole crude oil feedstream 10 prior to formation of the mixed feedstream 11. Alternatively, the catalyst 22 can be added to the fractionator bottoms 19 (broken line), or to the mixed feedstream 11 (broken line). The catalyst is present in relatively small concentrations measured in ppm by weight of the fresh feedstream and eventually is principally retained in the deposited coke product. To the extent that it remains in the heavy hydrocarbon fraction, it is recycled back to the coke drum. In this embodiment, the coking unit product stream 12 is heat exchanged with the fresh crude oil feedstream 10 in heat exchanger 39; a steam generator 60 is positioned downstream to further reduce the temperature of product stream 12 and produce process steam 61.

Figure 3:
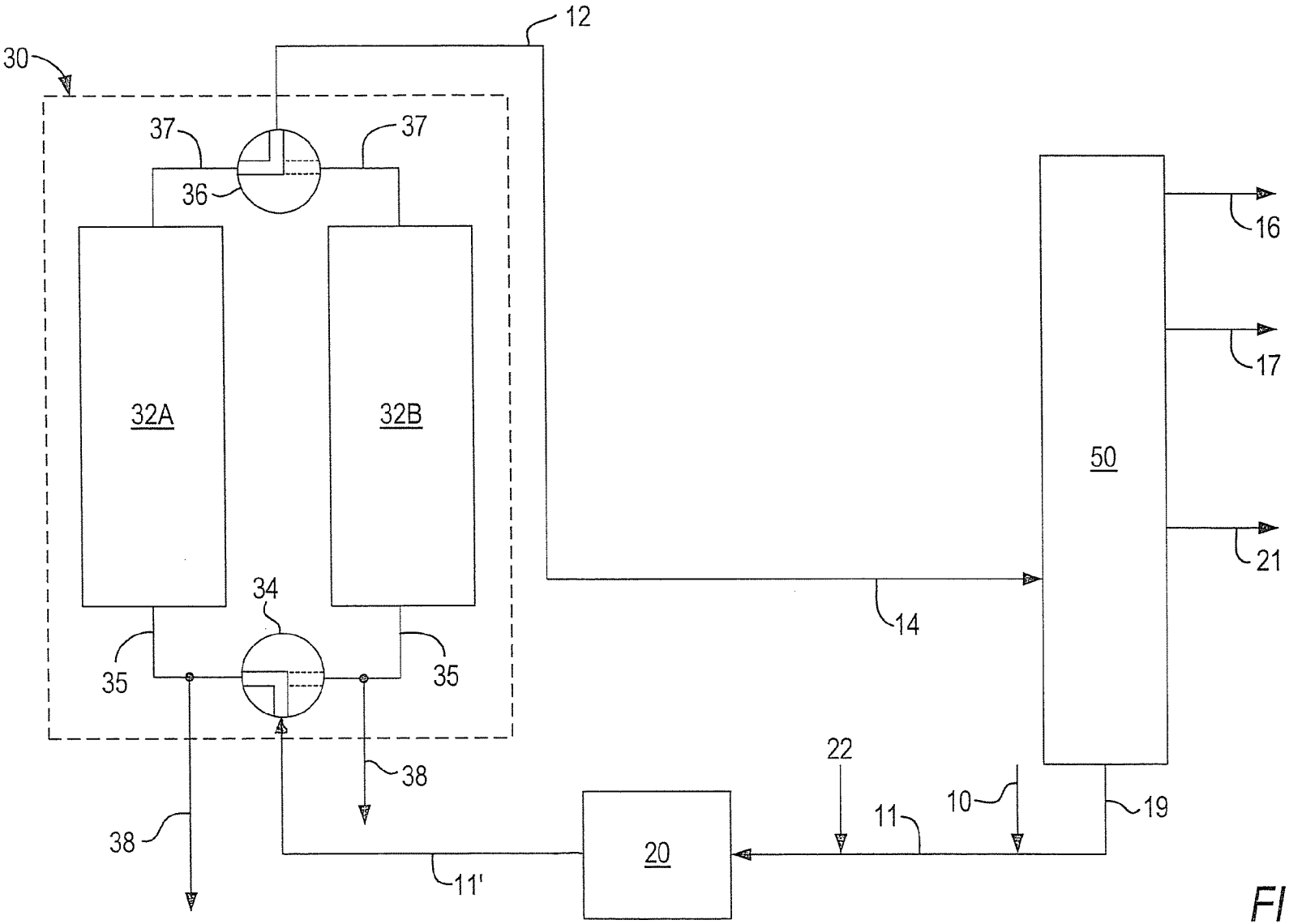
FIG. 3 is a schematic illustration of an embodiment in which the coking unit product stream is passed directly to the fractionation column.

With reference to the embodiment of FIG. 3, the coking unit product stream 12 is passed directly to the fractionator 50. Unlike the embodiments illustrated in FIGS. 1 and 2, in which a portion of the fractionator heavy gas oil is removed as side stream 18 and mixed with the coking unit product stream 12 for introduction into fractionator 50 as mixed stream 14, the coking unit product stream 12 in FIG. 3 is passed directly to the fractionator 50 without mixing with the heavy gas oil. In this embodiment, the catalyst stream 22 is introduced upstream of the furnace into the mixed feedstream 11 that is comprised of crude oil feedstock 10 and the bottoms 19 from the fractionator 50.

Figure 4:
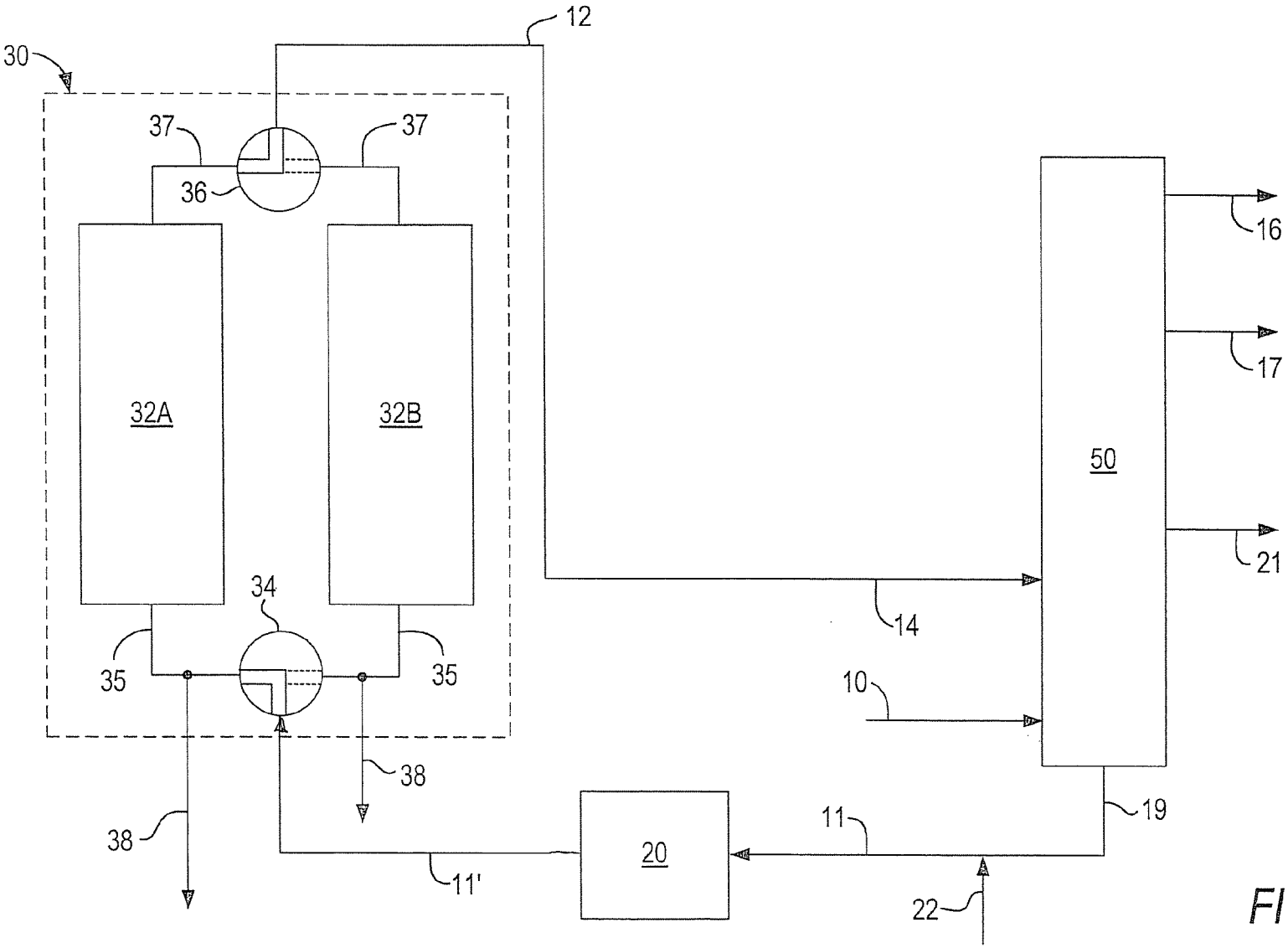
FIG. 4 is a schematic illustration similar to FIG. 3 in which the crude oil feedstream is introduced into the lower portion of the fractionation column where it is preheated with the bottoms of the fractionation column.

Referring now to FIG. 4, a further embodiment is illustrated in which the crude oil feedstream 10 is initially introduced into the bottom of the fractionator 50 in order to preheat the crude oil. In this embodiment, the liquid stream 19 discharged from the base of fractionator 50 is the mixture of the fractionator bottoms and the crude oil 10. The catalyst 22 is added to this mixture upstream of the furnace 20. As in the embodiment of FIG. 3, the coking unit product stream 12 is introduced into the fractionator without having passed through a flash vessel. As was previously noted, the flash vessel 40 can be used in this embodiment, but without the mixing of the heavy gas oil stream.

Other variations on the processing of the coking unit product stream will be apparent to those of ordinary skill in the art from this disclosure. Such modifications can be based upon the slate of products that are to be produced by the refinery, as well as cost considerations, e.g., the capital and operating costs associated with the construction and operation of the flash vessel 40.

The method of the invention represents an improvement over the prior art processes in which the heavy oil is fractionated at a cut point of 500° C. and higher to maximize distillate recovery, but leaves heavy fractions containing asphaltenes which cause processing difficulties, including short operating cycle times, equipment fouling and the thermal cracking and rejection of coke precursors. In the present process, the heavy fractions containing asphaltenes are thermally cracked to remove the coke precursors and thereby improve downstream unit operations such as hydrocracking and fluidized catalytic cracking.

EXAMPLE

A coking process model commonly used in the industry was modified to reflect the presence of light components and the corresponding yields based on the mid-boiling temperatures of the respective cuts. The model also included experimental data regarding the characteristics of the feedstream.

An Arabian heavy crude oil feedstream, the properties and composition of which are set forth in Table 1, where CRR is the Conradson carbon residue as a percent of the weight of the starting material, IBP and FBP are initial and final boiling points, respectively.

TABLE 1

| Property | Arab Heavy Crude Oil |
|---|---|
| API Gravity, ° | 27.2 |
| Specific Gravity | 0.892 |
| Carbon Content, W % | 84.45 |
| Hydrogen, W % | 12.42 |
| Sulfur, W % | 2.99 |
| Nitrogen, W % | 0.14 |
| CCR, W % | 3.99 |
| Boiling Point Range, ° C. | 36+ |
| Distillation ASTM D5307 | ° C. |
| IBP | 23° C. (due to dissolved light gasses) |
| 5 V % | 68 |
| 10 V % | 117 |
| 30 V % | 254 |
| 50 V % | 401 |
| 60 V % | 484 |
| FBP | 540 |

This feedstream is subjected to delayed coking at a temperature of 496° C. from the furnace outlet and at atmospheric pressure. The configuration of the delayed coking unit is as shown in FIG. 3. The coking unit yields are summarized in Table 2.

TABLE 2

| Yields | Stream # | Arab Heavy Crude Oil |
|---|---|---|
| Coke | 7 | 4.5 |
| Light Gases ($H_2$, $H_2S$, $C_1$-$C_4$) | 2 | 5.9 |
| Coker Naphtha | 3 | 20.2 |
| Coker Light Gas Oil | 4 | 33.3 |
| Coker Heavy Gas Oil | 5 | 36.2 |
| Total Liquid Products | (3 + 4 + 5) | 89.7 |
| Total | 2 + 3 + 4 + 5 + 7 | 100.0 |

As shown by the data of Table 2, the whole crude oil feedstream can be processed in the coking unit with a recovery of 89.7 weight percent of liquid products and shifting the heavy residual bottoms to coke formation of only 4.5 weight percent. In an example in which the feedstream to the coking unit is a vacuum residue, the coke product is 13.2 weight percent, or almost three times more than in the process of the present invention. This reduction in coke formation can be attributed to the hydrogen-donating capability of the light fractions that are present in the whole crude oil, which also leads to an increase in the liquid yields.

Although the process has been described in detail above and in the attached drawings, other changes and modifications will be apparent to those of ordinary skill in the art from this description and the scope of protection for the invention is to be determined by the following claims.

The invention claimed is:

1. A delayed coking process for the thermal cracking of whole crude oil in a delayed coking unit in which the whole crude oil feedstream is heated in a furnace to a predetermined maximum temperature, the process characterized by:

a. providing a whole crude oil feedstream having a boiling point in the range of from 36° C. to 565° C. and containing light fractions with a hydrogen content in the range from 12 to 16 W %;

b. mixing a homogeneous oil-soluble catalyst with the whole crude oil feedstream;

c. heating the whole crude oil and homogeneous oil-soluble catalyst feedstream in the furnace to a coking temperature in the range from 480° C. to 530° C.;

d. introducing the heated whole crude oil and homogeneous oil-soluble catalyst feedstream directly into the delayed coking unit;

e. passing the gaseous and liquid product stream from the delayed coking unit to a delayed coking unit fractionating column;

f. recovering as separate side streams from the fractionating column naphtha, light gas oil and heavy gas oil;

g. recycling a portion of the heavy gas oil and reintroducing it with the coking unit product stream into the fractionating column;

h. mixing at least a portion of the fractionating column bottoms with the whole crude oil feedstream to form a mixed whole crude oil feedstream; and i. introducing the mixed whole crude oil feedstream into the furnace.

2. The process of claim 1 in which the delayed coking unit includes two coking drums and the coking unit operates in a batch-continuous swing mode.

3. The process of claim 1 in which the whole crude oil feedstream contains from 1 to 60 w % of lower boiling components and in which the light fractions boil in the range from 36° C. to 370° C.

4. The process of claim 1 in which from 1 to 25 w % of the whole crude oil feedstream boils in the range from 36° C. to 370° C.

5. The process of claim 1 in which from 1 to 10 w % of the whole crude oil feedstream boils in the range from 36° C. to 370° C.

6. The process of claim 1 where the whole crude oil feedstream contains from 1 to 90 w % of light fractions.

7. The process of claim 1 where the whole crude oil feedstream contains from 1 to 50 w % of light fractions.

8. The process of claim 1 where the whole crude oil feedstream contains from 1 to 25 w % of light fractions.

9. A delayed coking process for the thermal cracking of whole crude oil in a delayed coking unit in which the whole crude oil feedstream is heated in a furnace to a predetermined maximum temperature, the process characterized by:

a. providing a whole crude oil feedstream having an initial boiling point in the range from 36° C. to 565° C. and containing light fractions with a hydrogen content in the range from 12 to 16 W %;

b. mixing a homogeneous oil-soluble catalyst with the whole crude oil feedstream;

c. heating the whole crude oil and homogeneous oil-soluble catalyst feedstream in the furnace to a coking temperature in the range from 480° C. to 530° C.;

d. introducing the heated whole crude oil and homogeneous oil-soluble catalyst feedstream directly into the delayed coking unit;

e. passing the gaseous and liquid product stream from the delayed coking unit to a flash unit;

f. recovering a light product gas stream including $H_2S$, $NH_3$ and C1 to C4 hydrocarbons from the flash unit;

g. transferring the bottoms from the flash unit to a delayed coking unit product fractionating column;

h. recovering as separate side streams from the fractionating column naphtha, light gas oil and heavy gas oil;

i. recycling a portion of the heavy gas oil and introducing it with the bottoms from the flash unit into the fractionating column;

j. mixing at least a portion of the fractionating column bottoms with the whole crude oil feedstream to form a mixed whole crude oil feedstream; and k. introducing the mixed whole crude oil feedstream into the furnace.

10. The process of claim 1 where the homogeneous oil-soluble catalyst is selected from the oxides, sulfides and salts of an organo-metal complex of metals in Groups IVB, VB, VI, VII, and VIIIB of the Periodic Table.

11. The process of claim 10, where the catalyst is a transition metal-based compound derived from an organic acid salt or an organo-metal compound containing molybdenum, vanadium, tungsten, chromium or iron.

12. The process of claim 11, where the catalyst is selected from the group consisting of vanadium pentoxide, molybdenum alicyclic and aliphatic carboxylic acids, molybdenum naphthenate, nickel 2-ethylhexanoate, iron pentacarbonyl, molybdenum 2-ethyl hexanoate, molybdenum di-thiocarboxylate, nickel naphthenate and iron naphthenate.

13. The process of claim 1 in which the furnace is a horizontal tube furnace.

14. The process of claim 1 which includes the step of washing the whole crude oil with water to desalt and remove dirt from the crude oil before the crude oil is heated.

15. The process of claim 1 which includes the step of injecting steam into the coking furnace at the rate from 1 to 3 W % in order to reduce the partial pressure of the oil in the coking drum.

* * * * *